US005262206A

United States Patent [19]

Rangaswamy et al.

[11] Patent Number: 5,262,206

[45] Date of Patent: * Nov. 16, 1993

[54] METHOD FOR MAKING AN ABRADABLE MATERIAL BY THERMAL SPRAYING

[75] Inventors: Subramaniam Rangaswamy, Stony Brook; Daniel R. Marantz, Sands Point, both of N.Y.; Robert A. Miller, Oak Park, Mich.

[73] Assignee: Plasma Technik AG, Wohlen, Switzerland

[ * ] Notice: The portion of the term of this patent subsequent to May 28, 2008 has been disclaimed.

[21] Appl. No.: 821,291

[22] Filed: Jan. 13, 1992

Related U.S. Application Data

[63] Continuation of Ser. No. 326,775, Mar. 21, 1989, abandoned, which is a continuation-in-part of Ser. No. 247,024, Sep. 20, 1988, Pat. No. 5,019,686.

[51] Int. Cl.[5] ..... B05D 1/08

[52] U.S. Cl. ..... 427/447; 427/449; 427/450; 427/452; 427/453; 427/455; 427/456; 427/540; 427/580

[58] Field of Search ..... 427/423, 426, 427, 447, 427/449, 450, 452, 453, 455, 456, 540, 580; 118/47

[56] References Cited

U.S. PATENT DOCUMENTS

| | | | |
|---|---|---|---|
| 1,930,373 | 4/1932 | Strubenrauch | 91/12.2 |
| 2,233,304 | 2/1941 | Bleakley | 29/DIG. 39 |
| 2,804,337 | 8/1957 | Marantz | 299/28.7 |
| 2,861,900 | 11/1958 | Smith et al. | 117/105 |
| 2,920,001 | 1/1960 | Smith et al. | 427/423 |
| 2,964,420 | 12/1960 | Poorman et al. | 117/21 |
| 3,064,114 | 11/1962 | Cresswell | 219/74 |
| 3,131,091 | 4/1964 | Jones | 118/47 |
| 3,304,402 | 2/1967 | Thorpe | 219/76 |
| 3,312,566 | 4/1967 | Winzeler et al. | 427/34 |
| 3,332,752 | 7/1967 | Batchelor et al. | 427/427 |
| 3,440,079 | 4/1969 | Jensen | 427/423 |
| 3,617,358 | 11/1971 | Dittrich | 117/105.2 |
| 3,640,757 | 2/1972 | Grubba | 117/93.1 PF |
| 3,723,165 | 3/1973 | Longo et al. | 427/423 |
| 3,947,607 | 3/1976 | Gazzard | 427/37 |
| 4,060,653 | 11/1977 | ODay, Jr. et al. | 427/423 |
| 4,321,483 | 11/1981 | Altorfer et al. | 427/37 |
| 4,358,053 | 11/1982 | Ingham et al. | 239/79 |
| 4,370,538 | 1/1983 | Browning | 219/121 PY |
| 4,386,112 | 5/1983 | Eaton et al. | 427/34 |
| 4,562,961 | 1/1986 | Guenard et al. | 239/79 |
| 4,588,608 | 5/1986 | Jackson et al. | 427/34 |
| 4,593,856 | 7/1986 | Browning . | |
| 4,696,855 | 9/1987 | Pettit, Jr. et al. | 427/423 |
| 4,711,627 | 12/1987 | Oeschale et al. | 431/30 |
| 4,740,395 | 4/1988 | Tsunekawa | 427/422 |
| 4,928,879 | 5/1990 | Rotolico | 427/423 |

FOREIGN PATENT DOCUMENTS

| | | |
|---|---|---|
| 516567 | 6/1920 | France . |
| 60-115771 | 6/1985 | Japan . |
| 60-115778 | 6/1985 | Japan . |
| 121648 | 5/1988 | Japan . |
| 1115738 | 5/1968 | United Kingdom . |
| 1257479 | 12/1971 | United Kingdom . |

*Primary Examiner*—Shrive Beck
*Assistant Examiner*—Benjamin L. Utech
*Attorney, Agent, or Firm*—Dykema Gossett

[57] ABSTRACT

A method for forming an abradable composite material and the material so formed. A filler is fed axially into a stream of high-temperature combustion gases such that the filler is entrained in the gaseous stream. The gaseous stream containing the filler is then used to atomize the molten tip of a metal wire which is continuously fed into the gaseous stream. The resultant gaseous stream which contains both the filler and the atomized molten metal is directed to the surface of a target. The filler and the molten metal impact the target and combine to form a substantially continuous metal matrix in which the interstices are filled by the filler. The composite material abrades readily upon frictional contact with a moving part.

18 Claims, 4 Drawing Sheets

METHOD FOR MAKING AN ABRADABLE MATERIAL BY THERMAL SPRAYING

This is a continuation of copending application(s) Ser. No. 07/326,775 filed on Mar. 21, 1989 now abandoned which is a continuation-in-part of U.S. patent application Ser. No. 247,024 which was filed on Sep. 20, 1988, now U.S. Pat. No. 5,019,686 the entire disclosure of which is incorporated herein by reference.

FIELD OF THE INVENTION

The present invention relates generally to materials and coatings which abrade readily, such as coating used to form abradable seals in turbine engines. More specifically, the present invention provides an improved abradable material and its method of manufacture.

BACKGROUND OF THE INVENTION

Materials which abrade readily in a controlled fashion are used in a number of applications, including as abradable seals. As will be appreciated by those skilled in the art, contact between a rotating part and a fixed abradable seal causes the abradable material to wear away in a configuration which mates with the moving part at the region of contact. That is, the moving part scrapes away a portion of the abradable seal so that the seal takes on a geometry which precisely fits the moving part. This effectively forms a seal having an extremely close tolerance.

One particular application of abradable seals is their use in turbine engines. Typically, the inner surface of the turbine shroud is coated to a predetermined thickness with an abradable material using a spray gun. In operation, as the turbine blades rotate, they expand somewhat due to the heat which is generated. The tips of the rotating blades then contact the abradable material and carve precisely defined grooves in the coating without contacting the shroud itself . It will be understood that these grooves provide the exact clearance necessary to permit the blades to rotate and thus afford an essentially custom-fitted seal.

In order for the turbine blades to cut grooves in the abradable coating, the material from which the coating is formed must abrade easily without wearing down the blade tips. This requires that a careful balance of materials in the coatings be achieved. In this particular environment, an abradable coating must also exhibit good resistance against particle erosion and other degradation at elevated temperatures. However, as known by those skilled in the art, these desirable characteristics are difficult to obtain using conventional methods of forming abradable coatings.

More specifically, many conventional abradable coatings are formed by plasma spraying the filler and metallic components as a powder, which requires that a number of parameters be carefully monitored. These parameters include the compositional characteristics of the feed powder, powder size, and the various operating conditions of the spray gun. However, even when these factors are closely monitored, conventional equipment and techniques have not been consistently successful in producing high-quality abradable coatings.

In more detail, conventional composite abradable coatings are fabricated by thermal spraying a feedstock selected from two general types. The simplest of these comprises a mixture of a metallic powder and a filler which is usually a non-metallic powder. That is, a blend of the discrete particles of each constituent is prepared which is then sprayed using a plasma spray gun. However, these powder mixtures often segregate, not only in storage, but also in the particle spray stream itself, both of which adversely affect the microstructure of the resultant coating. It is known that particle segregation produces localized regions in the coating consisting predominantly of a single powder constituent. This in turn produces coatings of non-uniform composition and hardness which have inferior serviceability. This lack of uniformity may also be caused by preferential vaporization or other thermal transformation of one of the powder constituents, particularly where a plastic is used as a component. In addition, the use of mixed or blended powders also makes it difficult to adjust the ratio of the constituents to produce graded coatings requiring different blends of feedstock for each layer of the coating.

In the other general class of spray powders, the two constituents are bonded together to form composite particles. A number of bonding techniques are known, such as cladding a first material in powder form with a second material, or by simply bonding two powders together with a suitable binder. However, the binder may not be effective in preventing separation of the two dissimilar materials. Moreover, not only are cladding techniques expensive, but there may also be preferential vaporization of the cladding, which reduces the compositional balance of the coating, and a single powder composition cannot be used to form a coating having different characteristics through the depth of the coating.

For many materials, the production of satisfactory abradable coatings requires the use of extremely high velocities which cannot be achieved with conventional combustion flame spray guns. While plasma spray guns provide high velocities, they operate at such high temperatures that they can cause vaporization and thermal degradation, such as vaporization of the plastic constituent and oxidation of the powder constituents, the latter being accelerated by the turbulence of the spray stream.

Therefore, it would be desirable to provide a method for forming an abradable material by which the problem of particle segregation can be reduced or eliminated. It would also be desirable to provide such a method with the added feature of producing high-quality abradable coatings without producing any significant degradation of the feedstock. It would further be desirable to provide such a method by which a compositional gradient could be attained in a coating by allowing independent control of feedstock constituents without the use of a complex powder metering system and which avoids the steep temperature and velocity gradients of plasma spraying. The present invention provides a method of forming an abradable material which achieves these goals and also provides a novel abradable material formed by the method of the present invention.

SUMMARY OF THE INVENTION

In one aspect, the present invention provides a method for making an abradable material by introducing a filler, preferably a powdered non-metal such as plastic, into a stream of high-temperature combustion gases, thereby entraining the filler in the gas stream. The filler is preferably fed axially into the combustion gas stream, thereby avoiding uncontrolled lateral disbursement as the particles enter the high-velocity gas stream. The filler is heated and propelled at an extremely high velocity by the combustion gases along an axis which intersects a molten metal. The stream of the high-temperature combustion gases in which the filler is carried atomizes the molten metal, such that the molten metal is entrained in the stream along with the filler. Thus, a composite stream is formed containing both the filler and the atomized molten metal. The composite stream or spray is then directed toward a target, whereby the heated filler and molten metal impact the target surface at a high velocity to form a layer or coating of an abradable material. Upon impact, the molten metal forms a substantially continuous metal matrix in which the filler is embedded in the interstices. The resultant coating is readily abradable and is well adapted for use in forming abradable seals.

In one preferred aspect, the method of the present invention is carried out using the high-velocity flame spray apparatus disclosed in the aforementioned U.S. patent application Ser. No. 247,024. Therein, a flame spray apparatus is disclosed which includes a body portion having a feedstock bore with an inlet adapted to receive a feedstock and an outlet communicating with a converging throat. The converging throat is preferably coaxially aligned with the feedstock bore. The body includes a fuel passage with a fuel-receiving inlet and an outlet surrounding the feedstock bore and communicating with the converging throat. The body portion of the gun is further provided with an oxidant passage having an inlet adapted to receive an oxidant gas and an outlet communicating with the throat. Hence, the throat separately receives a fuel and an oxidant from the passage outlets prior to any mixing of the fuel and the feedstock filler. The throat includes a conical wall which is spaced sufficiently from the fuel and oxidant outlets to provide mixing and partial combustion of the fuel and oxidant within the throat. Upon ignition of the fuel and oxidant, a flame front is established within the throat that rapidly heats the incoming fuel liberating energy by the resultant chemical reactions to provide the driving force for sustaining the continuous detonations. In this manner, continuous detonation is established and the feedstock is accelerated through an outlet at the apex of the conical wall. The apex of the conical wall is in alignment with the feedstock bore, whereby the accelerated feedstock is directed through the gun barrel toward the tip opening in a straight bore nozzle. In one embodiment, the heated combustion gases carrying the feedstock are at a temperature sufficient to melt the tip of a metal wire which is then atomized by the high-velocity gas stream. In another embodiment, a two-wire electric arc assembly is included with the preferred spray apparatus such that electric arc heating of the wires melts the wire tips, whereby the molten metal is atomized and entrained in the stream issuing from the gun throat to form a composite spray.

In still another aspect, the present invention provides abradable materials which exhibit superior uniformity and which have lower metal oxide content than many conventionally sprayed materials. The abradable materials comprise a matrix of metal in which a filler, preferably a soft, friable non-metal is uniformly dispersed in the matrix. In one embodiment, the abradable materials of the present invention comprise composite abradable seals for use in such applications as abradable turbine engine seals. The inventive abradable materials and seals are formed using the method of the present invention. In one preferred embodiment, the abradable materials of the present invention comprise a metal matrix in which a plastic is uniformly distributed in the matrix interstices.

DESCRIPTION OF THE PREFERRED EMBODIMENTS

The present invention provides a novel abradable material and a method of making the abradable material. In a preferred embodiment, the material of the present invention is formed as an abradable coating on the surface of a part. In its most preferred embodiment, the abradable coating of the present invention comprises an abradable seal.

In accordance with the method of the present invention, a stream of high-temperature, high-velocity combustion gases is formed with a combustion flame spray apparatus, the most preferred configuration of which is set forth in U.S. patent application Ser. No. 247,024 incorporated by reference above. It will be understood by those skilled in the art, however, that other, preferably high-velocity, spray systems may be utilized to accelerate the filler particles.

Figure 1:
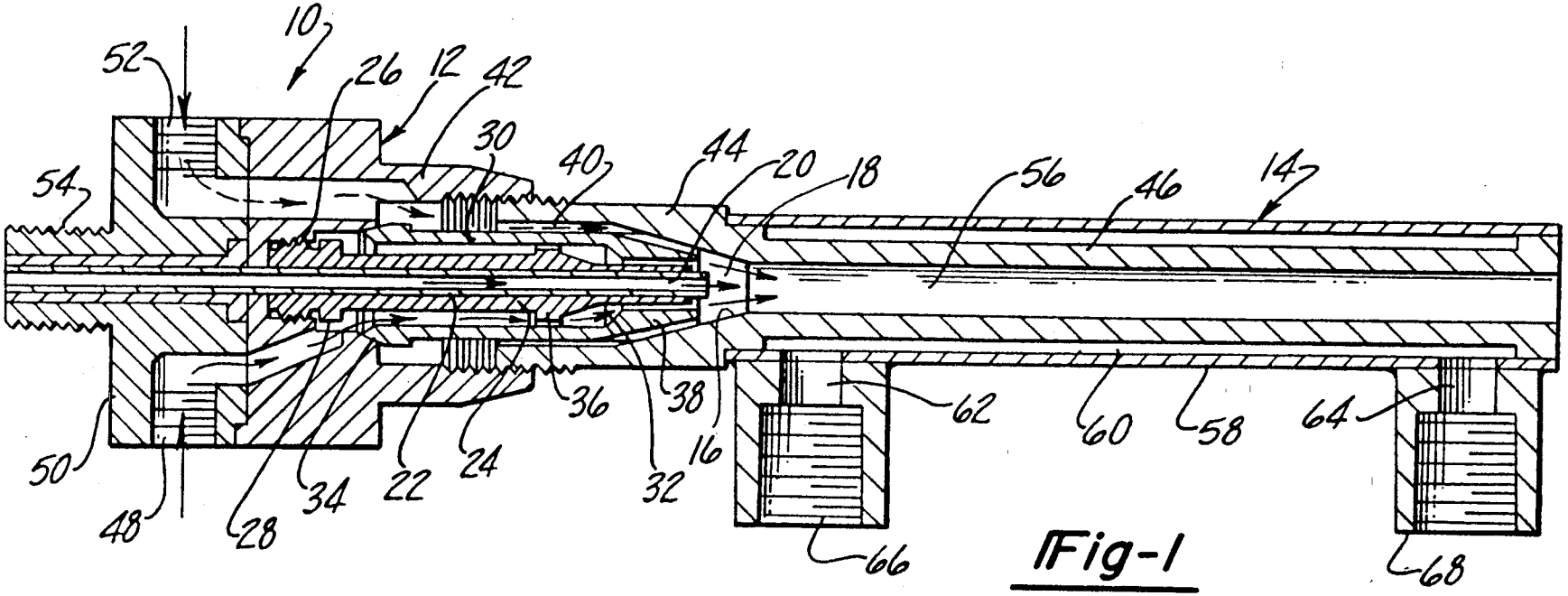
FIG. 1 is a cross-sectional view of a preferred flame spray apparatus for use in practicing the method of the present invention, the wire and wire feed mechanism not being illustrated in this view for simplicity.

Referring now to FIG. 1 of the drawings, flame spray apparatus 10 is illustrated generally having burner housing 12, which is shown integral with barrel 14. Conical wall 16 of burner housing 12 defines a converging throat 18 in which a continuous detonation reaction is carried out. Feedstock supply bore 20 is defined by feedstock supply tube 22, which is closely received within feedstock housing 24. Feedstock housing 24 in the disclosed embodiment is provided with a threaded end 26 which is received in a tapped portion of burner housing 12. Collar 28 may be provided to aid in seating feedstock housing 24 in position. Feedstock housing 24 and feedstock supply tube 22 are disposed within fuel supply nozzle 30, such that an annular fuel passage 32 is defined. End 34 of fuel nozzle 30 is preferably tapered and press-fitted into burner housing 12.

Feedstock housing 24 includes a second collar or flange portion 36 which engages fuel nozzle 30. Collar 36 is provided with longitudinal channels axially aligned with feedstock bore 20. Fuel flowing through annular passage 32 in the direction shown by the arrows is thus not significantly obstructed by collar 36 during operation. That is, collar 36 has a channeled outer surface such that it can function as a spacer with respect to fuel nozzle 30 and yet still allow substantially unconstricted flow of fuel through annular fuel passage 32. In a similar manner, end portion 38 of fuel nozzle 30 is provided with a series of substantially parallel longitudinal channels. Again, this channel construction allows end portion 38 of fuel nozzle 30 to engage conical wall 16, while permitting an oxidant to flow through annular oxidant passage 40 into converging throat 18. Annular oxidant passage 40 is an annulus defined by sections 42 and 44 of burner housing 12. It will be noted that section 44 also provides conical wall 16. In order to rigidly attach section 44 to section 42, section 42 is tapped to receive a threaded portion of section 44.

Leading into annular fuel passage 32, fuel supply passage 48 is provided which extends through end portion 50 of burner housing 12 and is in flow communication with annular fuel passage 32. This continuous passage serves as a channel through which a fuel is conveyed to a flame front in converging throat 18. Similarly, annular oxidant passage 40 is in flow communication with oxidant inlet passage 52. End portion 50 includes connector 54 which may be threaded for the connection of a feedstock supply hose as will be explained more fully in the method of the present invention. A filler feedstock is introduced into feedstock bore 20 via connector 54.

The cross-sectional area of feedstock bore 20 is preferably substantially less than the cross-sectional area of annular fuel passage 32 and annular oxidant passage 40, such that powdered feedstock is fed into converging throat 18 at a sufficient velocity to move through converging throat 18. Supply bore 20 is generally less than about 15% of the cross-sectional areas of either annular fuel passage 32 or annular oxidant passage 40. Also, the ratio of the diameter of supply bore 20 to the internal diameter of spray passage 56 is generally about 1 to 5. The ratio of cross-sectional areas is thus generally about 1 to 25.

Barrel 14, which is a tubular straight bore nozzle, includes hollow cylindrical section 46 which defines spray passage 56. As will be described more fully, high-velocity particles of a filler feedstock are propelled through passage 56 as a collimated stream. In order to prevent excessive heating of barrel wall 46 and to provide an effect referred to herein as "thermal pinch," a phenomenon which maintains and enhances collimation of the particle stream, heat exchange jacket 58 is provided which defines an annular heat exchange chamber 60. Heat exchange chamber 60 is limited to barrel 14, so that heat is not directly removed from converging throat 18. In use, a heat exchange medium, such as water, is flowed through heat exchange chamber 60 via channel 62 and 64. Hoses (not shown) are each attached at one end to connectors 66 and 68 to circulate heat exchange medium through heat exchange chamber 60.

Figure 2:
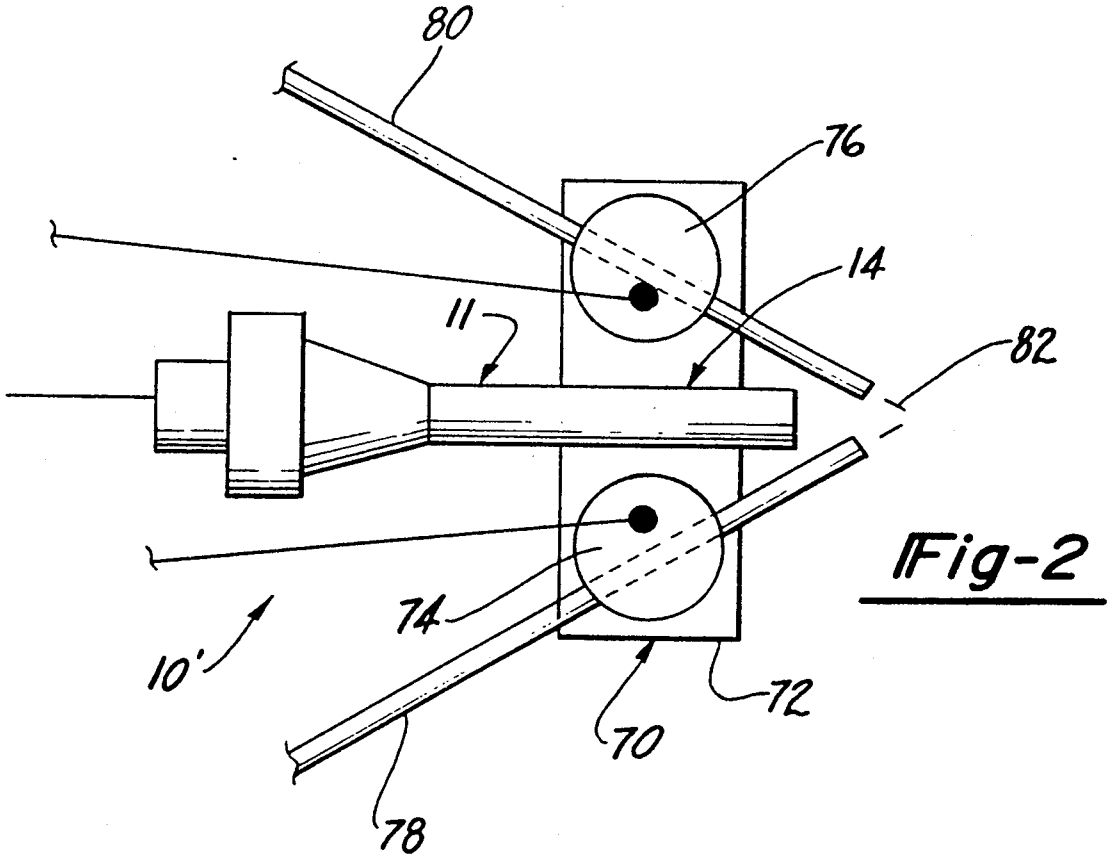
FIG. 2 is a plan view of the preferred flame spray apparatus for use in the present invention in which a two-wire arc assembly is shown.

Referring now to FIG. 2 of the drawings, flame spray apparatus 10 includes a molten metal supply means illustrated here as a two-wire electric arc assembly (not shown in FIG. 1 for simplicity). Arc assembly 70 includes carriage 72 which houses wire guides 74 and 76. Wire guides 74 and 76 are provided to guide wires 78 and 80 at a predetermined rate toward arc zone 82. The included angle of wires 78 and 80 is preferably generally less than about 60 degrees in most applications. In a preferred method herein, an electric arc of predetermined intensity is struck and continuously sustained between the ends of the wire electrodes. In another embodiment, the heat of the collimated combustion gas stream melts the tips of wires 78 and 80. It may be suitable in some applications to use a single wire 78, wherein the heat of the combustion gases melts the wire. In the disclosed embodiment, wires 78 and 80 are continuously fed toward an intersecting point in arc zone 82 as they are melted and consumed as atomized molten metal. While the distance of arc zone 82 from the end of barrel 18 is not critical and can be adjusted to regulate various characteristics of the coating or article which is formed during the spraying operation, the ends of wires 78 and 80 are preferably located from about 4 to about 10 centimeters from the end of barrel 14 in most applications. The arc and molten metal wire ends should be positioned within the collimated particle stream issuing from barrel 14; that is, along the longitudinal axis of barrel 14.

A number of fuel and oxidant sources may be used in the present invention. Gas, liquid or particulate fuels or oxidants may be suitable as described in the aforementioned United States patent application. For the oxidant, most oxygen-containing gases are suitable. Substantially pure oxygen is particularly preferred for use herein. Suitable fuel gases for achieving high-velocity thrust of spray materials in the present invention are hydrocarbon gases, preferably high-purity propane or propylene, which produce high-inertia oxidation reactions. Hydrogen and other liquid and gaseous fuels may also be suitable in some applications. In the present invention, flame temperature and thus the temperature of the filler feedstock, can be controlled by proper fuel selection as well as by controlling gas pressures and the dwell or residence time of the feedstock particles in converging throat 18 and bore 56.

Also, by controlling the composition of the fuel and the gas pressure, a wide range of particle velocities can be obtained. The preferred fuel gas pressure is from about 20 to 100 psig and more preferably from about 40 to about 70 psig. The oxidant gas pressure will typically range from about 20 to about 100 psig and preferably from about 40 to about 80 psig for most applications. When operating within these ranges, velocities of the combustion products emerging from barrel 14 will be supersonic and significantly greater than velocities of other conventional commercial flame spray guns under similar operating conditions. It will be appreciated that the nature of the fuel gas and its mass flow characteristics closely dictate velocity.

Figure 3:
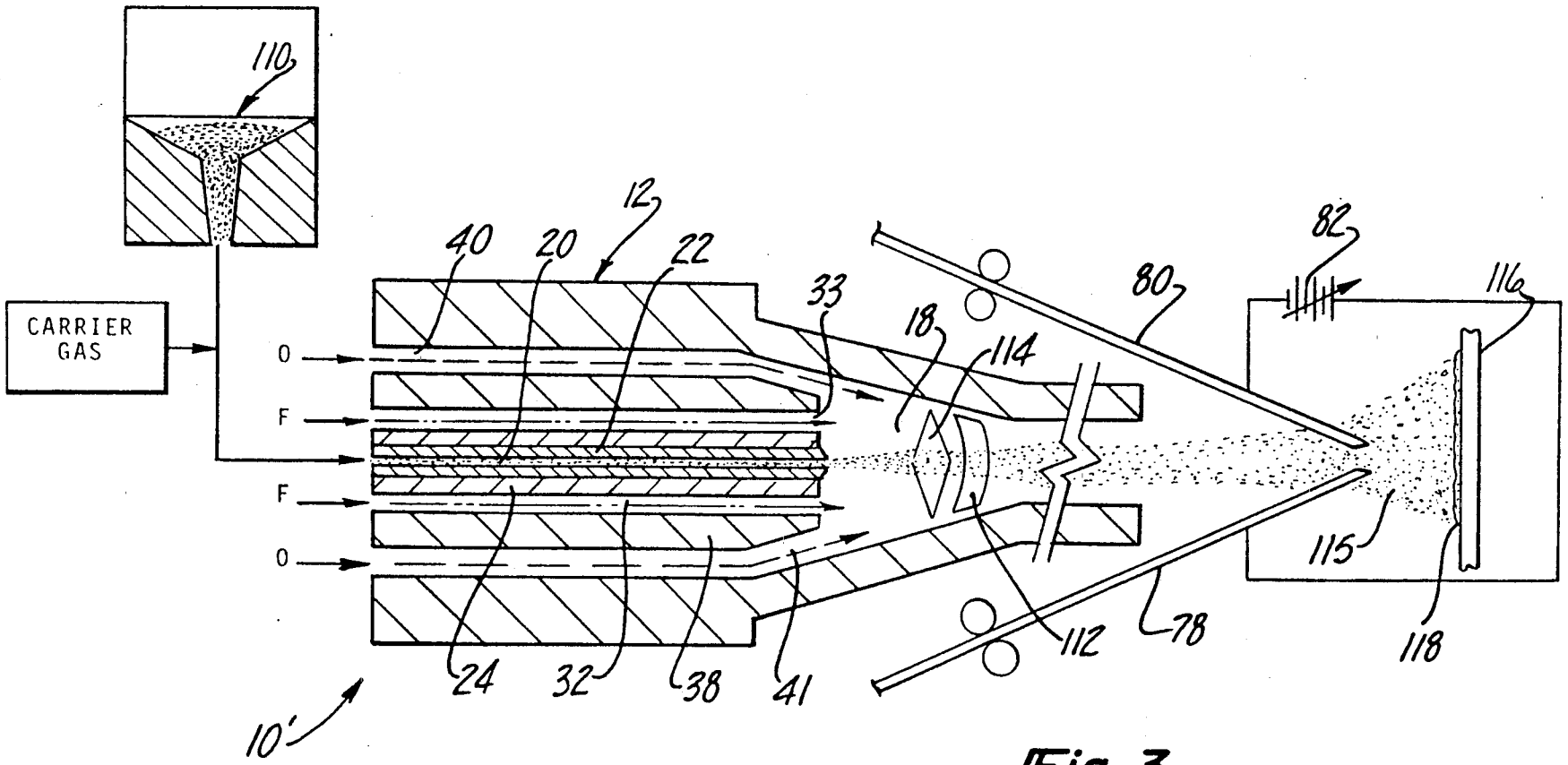
FIG. 3 is a diagrammatic representation which demonstrates the formation of a flame front in the converging throat of the spray gun and the creation of a composite collimated particle stream which forms the abradable material of the present invention.

Referring now to FIG. 3 of the drawings, flame spray apparatus 10 is shown diagrammatically in which a filler feedstock 110 is injected through feedstock bore 20. In this embodiment, filler 110 is in particulate or powdered form and is entrained in a carrier gas, preferably one which is inert with respect to the materials sprayed. Flame front 112 and shock 114 are shown in throat 18. After atomizing the molten metal tips of wires 78 and 80, a composite stream 115 is formed which impacts a target 116 to form a layer of abradable material 118 in accordance with the present invention.

A number of fillers are suitable for use in forming the abradable materials of the present invention. The most preferred filler for use herein is plastic. As used herein, the term "filler" shall be defined generally as follows: a material which is substantially physically and chemically thermally stable before the material is sprayed, during spraying in accordance with the present invention and in the service environment of the final abradable material. Further, the preferred filler has a hardness value less than that of the material which is to be used to abrade the abradable material, i.e. softer than the material of which the moving part that contacts the abradable material is formed. Finally, the preferred filler is chemically stable with the matrix material during spraying in accordance with the present invention and during service of the abradable coating. When the filler is supplied as a powder, it must also be flowable. Also, the preferred fillers used in the present invention are not significantly thermally degraded in the method of making the abradable material. Although the filler is preferably provided in particulate form, such as a powder, it may also be in rod form.

Therefore, in general, soft, friable fillers are preferred herein, and they may be either organic or inorganic. Particularly preferred fillers are synthetic polymers of the type used as plastics, fibers or elastomers. Natural polymers having the desired characteristics may also be suitable. Preferred synthetic polymers or copolymers include acrylic resins, such as polymers or copolymers of acrylic acid, methacrylic acid, esters of these acids, and acrylonitriles. Also preferred for use herein are bismaleimides produced by condensation of a diamine with maleic anhydride, for example by condensation of methylene dianiline with maleic anhydride; fluoroplastics such as polytetrafluoroethylene and polyvinylfluoride; wholly aromatic copolyesters such as liquid crystalline polymers, for example those sold under the trademarks Xydar TM by Amoco Chemicals Corp. and Vectra by Hoechst Celanese; polyamide-amides, for example that sold under the trademark Torlon TM by Amoco Chemicals Corp.; polyimides, both thermoplastic and thermoset; sulfone polymers, including polysulfones, polyarylsulfone and polyethersulfone; plastic polyesters such as aromatic polyesters, preferably polyarylates made from iso and terephthalate with bisphenol aromatic homopolyester, polybutylene terephthalate, polyethylene terephthalate, wholly aromatic copolyester; silicone resin; epoxy resin; polyetheretherketone and polyphenylene sulfide. Generally, most thermoplastics and thermosets having the characteristics described are suitable for use in the present invention as the filler component. The thermoplastics and thermosets useful in the present invention encompass a broad range of molecular weights, for example from about 2000 to about 1,500,000. Values outside this range and monomers and prepolymers may also be suitable.

As stated, the filler used herein for the resultant abraded material should be soft and friable to produce an abradable material having the desired characteristics. In addition to polymers, other non-metals preferably used as the filler component of the present invention include solid lubricant materials such as boron nitride, calcium fluoride, molybdenum sulfide, fluorinated (non-graphitic) carbon, fluorinated graphite, non-graphitic carbon and graphite and combinations thereof.

Some soft ceramic materials are also suitable as a filler material, such as calcium carbonate; clays such as kaolin and bentonite; calcium phosphates; wollastonite; pyrophyllite; perlite; gypsum; barite; hydrated alumina; silica; and diatomite, including calcined diatomite and combinations thereof. In general, most non-abrasive minerals which are not unduly hardened in the flame spray process are acceptable. In addition it may be suitable to utilize certain soft metals as the filler component in the present invention.

The filler of the preferred embodiment of the present invention is a powder, preferably having a particle size of from about 5 microns to about 100 microns, although diameters outside this range may be suitable in some applications. The most preferred filler powders have a particle diameter of between from about 15 to 70 microns. The filler powder should be flowable within the requirements of the spray apparatus and should have a fairly narrow size distribution, such that excessive fines or large particles are not present. The techniques used to produce these powders will be well-known by those skilled in the art.

As stated, the metal for the metal matrix of the abradable material of the present invention is supplied preferably as a wire, one end of which is positioned in the path of the stream of combustion gases in which the filler is entrained as shown in FIG. 3 of the drawings. A single wire may be utilized with melting of the tip being achieved by the heat of the combustion gases. Alternatively, two wires as shown in FIG. 3 may be used with or without striking an arc between the two wire tips. Where an arc is struck, two-wire arc electric heating melts the wire tips, providing the source of molten metal which is then atomized by the gaseous stream. Where two wires are used, they may be the same or different metals. Accordingly, the wire must be consumable by one of these means.

Metals which are suitable for use in the present invention in forming the metal matrix component of the inventive abradable material are preferably supplied in wire form. Preferred metals include aluminum and its alloys, such as aluminum 1100, 1350, and other 1XXX series; aluminum/copper alloys in the 2XXX series; aluminum/silicon alloys such as 4043, 4047, and other 4XXX series; aluminum/magnesium alloys such as 5356 and other 5XXX series; aluminum/magnesium/silicon alloys in the 6XXX series; and aluminum/titanium alloys. Also suitable are copper and its alloys including copper UNS C101000-C15735; copper/aluminum alloys such as UNS C60600-C64400 (aluminum bronze); copper/nickel alloys such as UNS C70100-C72500. Also suitable are nickel and its alloys, including nickel UNS N02200, UNS N02201, and UNS N02205; nickel/copper alloys including UNS N04400, UNS N04404, and UNS N04405; and nickel/chromium alloys such as UNS N06003. Other metals which are suitable for use in forming the metal matrix of the inventive abradable coatings are nickel and/or cobalt-based superalloys and high-temperature or corrosion-resistant alloys. Preferred are MCrAlX alloys, wherein M is Fe, Ni, Co, or combinations thereof; X is rare earth metal, including La, Ce, Pr, Nd, Pm, Sm, Eu, Gd, Th, Dy, Ho, Er, Tm, Yb, Lu, Hf and combinations thereof, or where X is Zr, Si, and combinations thereof. Also preferred for use herein are intermetallic compounds, including the aluminides of Ni, Ti and the like. Also suitable are steels, including low-carbon, alloy, and stainless steel. Also acceptable are pure metals, including nickel, cobalt, iron, copper, aluminum, and any other metals which can be formed into wires.

The gage of the wire is not critical, but will generally range from about 0.030 to about 0.25 inches in diameter. Values outside this range may also be suitable. As the molten metal tips of the wires melt and are atomized, the wire or wires are advanced in the direction of the stream at a rate which provides a constant supply of atomized molten metal.

One of the many advantages provided by flame spray apparatus 10 is the ability to regulate the velocity at which a particulate filler is injected into the flame front. Unlike many devices, flame spray apparatus 10 permits independent regulation of particle injection rate, fuel gas flow rate, and oxidant gas flow rate. The feedstock particles are injected into the flame front by an independent stream of an inert carrier gas. By allowing independent regulation of flow rates, turbulence in converging throat 18 is substantially reduced by maintaining the pressure of the carrier gas at a higher value than the fuel gas pressure, which increases particle velocities. The range of carrier gas pressure is preferably from about 40 to about 70 psig, more preferably from about 50 to about 60 psig, and most preferably always greater than the pressure of fuel gas. Also, although the relative dimensions of outlets 33 and 41 shown in FIG. 3 can vary widely, as stated, the inner diameter of feedstock supply tube 22 is generally considerably smaller than the cross-section of annular fuel passage 32 or annular oxidant passage 40. The ratio of the cross-sectional areas of feedstock supply bore 20 to spray passage 56 of barrel 14 is generally about 1 to 25 to reduce the likelihood of the filler particles contacting and adhering to the internal surface of barrel 14 during spraying. By maintaining the carrier gas pressure above about 50 psig, where the fuel gas pressure is from about 45 to 65 psig and the oxidant gas pressure is from about 70 to 90 psig, a phenomenon referred to as spitting is prevented which occurs at lower carrier gas pressures. Spitting results from radial movement of particles which may adhere to conical wall 16 and is believed to occur at lower carrier pressures due to increased turbulence. Thus, maintaining the carrier gas pressure at high values reduces turbulence.

As the filler particles move into converging throat 18, the thermal and kinetic energy of the particles substantially increase due to an exothermic continuous detonation reaction. The energetic filler particles pass through converging throat 18 to form a collimated stream of high-energy particles which are propelled in a substantially straight line through passage 56 of barrel 14. As stated, there is also a reduction in turbulent radial movement of the spray particles. By providing a non-turbulent flow of gas into converging throat 18, and sustaining a continuous detonation reaction confined to converging throat 18, axial, substantially non-turbulent flow of the combustion gases and the filler particles is achieved, which results in a high-velocity collimated particle stream. Also, as the particle stream passes through barrel 14, spreading of the stream is reduced by removing heat from barrel wall 46 with heat exchange jacket 58. By cooling barrel 14 in this manner, a thermal pinch is created which further reduces any radial movement of the energized particles toward the side walls of barrel 14.

As the collimated particle stream exits barrel 14, it passes through arc zone 82. During this passage, wires 78 and 80 are electrically energized in the most preferred embodiment to create a sustained electric arc between the ends of the wires. A voltage sufficient to sustain an arc between the ends of wires 78 and 80 is maintained by a suitable power supply. A voltage between about 15 and about 30 volts is generally sufficient. As molten metal forms at the wire ends, the particle stream atomizes the molten metal. To maintain the electric arc and, as stated, to provide a continuous supply of molten metal to the spray stream, wires 78 and 80 are advanced at a predetermined rate. As the molten metal is atomized, a combined or composite particle stream 115 is formed which contains both the filler and the atomized molten metal. Although some turbulence is created by the presence of wires 78 and 80, the composite particle stream maintains good collimation. The composite stream is then directed to target 116 where it forms the abradable material 118 of the present invention.

The metal matrix of the resultant coating in a typically preferred commercial abradable seal preferably comprises from about 40% to about 95% by volume of the abradable coating with the filler component comprising from about 5% to about 60% by volume of the abradable material. In a specific application, the method of the present invention is used to form an abradable coating on the surface of a part. In a most preferred embodiment, the present invention comprises forming an abradable seal for a moving part, such as an abradable seal for turbine engines. In this aspect, the method of the present invention is utilized to form an abradable coating on the inner surface of a turbine engine shroud. Once the coating is solidified, the turbine engine blades are rotated to cut grooves into the abradable coating to form a well-fitted abradable seal.

The following example is provided to more fully describe the present invention and is not intended to in any way limit its scope.

EXAMPLE

Figure 4:
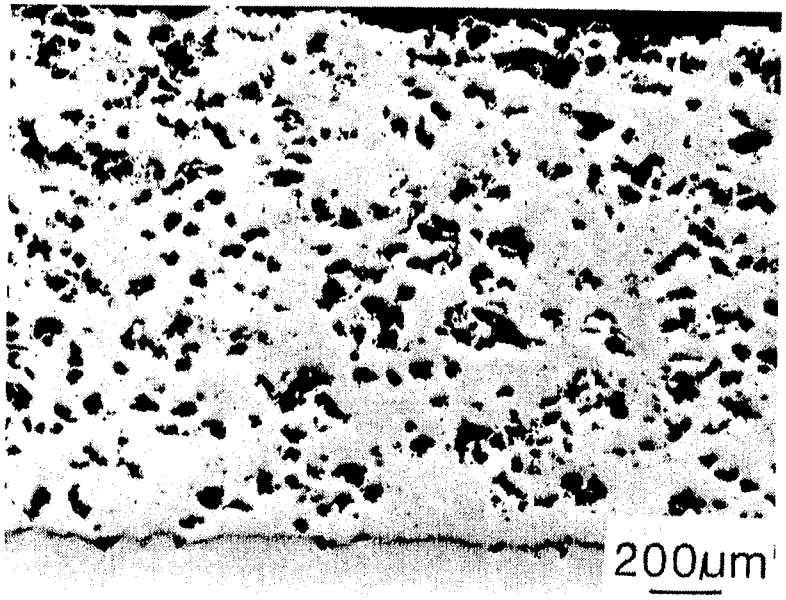
FIG. 4 is a photomicrograph of an abradable material in cross-section made in accordance with the present invention.

Using a spray gun substantially shown in FIGS. 1–3 of the drawings, an abradable material was formed as follows: two wires of aluminum 1100 having 1/16 inch diameters were fed at a rate of 34.5 grams/minute into the spray stream. The filler component was a thermoplastic polyimide which was fed axially into the combustion gas stream in the manner described above at a rate of about 15g/min. The thermoplastic powder size was substantially −140+325 mesh. The oxidant gas was substantially pure oxygen at a flow rate of 225 liters/minute. Propylene was used as the fuel gas at a flow rate of 46 liters/minute. Two powder carrier gases were tested, nitrogen at 85 liters/minute and carbon dioxide at 67 liters/minute. The distance between the target and the gun as measured from the arc zone was approximately 11.5 inches. The combustion gas velocity was approximately sonic. The resultant abradable material is shown in cross-section at FIG. 4 which is a photomicrograph.

While a particular embodiment of this invention is shown and described herein, it will be understood of course that the invention is not to be limited thereto since many modifications may be made, particularly by those skilled in the art in light of this disclosure. It is therefore contemplated that the appended claims cover any such modifications as fall within the true spirit and scope of this invention.

What is claimed is:

1. A method of making an abradable material, comprising the steps of:

axially feeding a particulate filler material using an axial stream of a carrier gas into a stream of high-temperature combustion gases at a first location to heat, accelerate and entrain said filler material in said stream of high-temperature combustion gases such that a high-temperature, high-velocity substantially collimated stream of filler material is formed, said first location being disposed in a chamber and said combustion gases being introduced in said chamber by the independent introduction of separate steams of a fuel gas and an oxidant gas into said chamber;

atomizing at a second location downstream of said first location molten metal directly from the end of at least one consumable wire with said stream of high-temperature combustion gases having said entrained filler material such that said atomized molten metal is entrained in said stream of high-temperature combustion gases along with said filler material to form a substantially collimated stream of high-temperature, high-velocity filler and atomized metal;

directing said stream of high-temperature combustion gases having said entrained filler material and said entrained atomized molten metal toward a target; and forming an abradable material having a substantially continuous metal matrix in which said filler material is contained on said target with said stream of high-temperature combustion gases having said entrained atomized molten metal and said filler material.

2. The invention recited in claim 1, wherein said stream of combustion gases is formed in a combustion spray gun at supersonic velocity.

3. The invention recited in claim 1, wherein said molten metal is supplied by placing the tip of at least one metal wire in said stream of high-temperature combustion gases having said entrained filler material such that said metal wire tip is melted by said combustion gases.

4. The invention recited in claim 1, wherein said molten metal is supplied by providing two metal wires and means for supplying an electrical current to said metal wires, and establishing an electric arc between the tips of said wires, said electric arc being sufficient to melt said tips of said metal wires.

5. The invention recited in claim 1, wherein said particulate filler material is synthetic polymer powder selected from the group consisting of thermosetting polymers, thermoplastic polymers and combinations thereof.

6. The invention recited in claim 1, wherein said particulate filler material is a powder of a solid lubricant material selected from the group consisting of boron nitride, calcium fluoride, molybdenum sulfide, fluorinated non-graphitic carbon, fluorinated graphite, non-graphitic carbon, graphite, and combinations thereof.

7. The invention as recited in claim 1, wherein said filler material is a ceramic powder selected from the group consisting of calcium carbonate, kaolin, bentonite, calcium phosphate, wollastonite, pyrophyllite, perlite, gypsum, barite, hydrated alumina, silica, diatomite, calcined diatomite and combinations thereof.

8. The invention as recited in claim 1, wherein said filler material is supplied as a rod.

9. The invention as recited in claim 1, wherein said molten metal is selected from the group consisting of aluminum, aluminum/silicon alloys, aluminum/magnesium alloys, aluminum/magnesium/silicon alloys, and aluminum/titanium alloys and combinations thereof.

10. The invention as recited in claim 1, wherein said molten metal is selected from the group consisting of copper, copper/aluminum alloys, and copper/nickel alloys and combinations thereof.

11. The invention as recited in claim 1, wherein said molten metal is selected from the group consisting of nickel, nickel/copper alloys and nickel/chromium alloys and combinations thereof.

12. The invention as recited in claim 1, wherein said molten metal is selected from the group consisting of nickel and cobalt-based superalloys.

13. The invention as recited in claim 1, wherein said molten metal is a MCrAlX alloy, wherein X is selected from the group consisting of rare earth metals, Y, Hf, Zr, and Si; and wherein M=Fe, Ni, Co and combinations thereof.

14. The invention as recited in claim 1, wherein said molten metal is selected from the group consisting of nickel aluminides and titanium aluminides.

15. The invention as recited in claim 1, wherein said molten metal is selected from the group of steels consisting of low-carbon steel, alloy steel and stainless steel.

16. The invention as recited in claim 1, wherein said molten metal is selected from the group of pure metals and combinations of pure metals consisting of nickel, cobalt, iron, copper, and aluminum.

17. A method for making a material as recited in claim 1, wherein said filler material is a plastic and said metal is selected from the group consisting of copper and copper alloys.

18. A method for making an abradable material, comprising the steps of:

heating and accelerating combustion gases in a chamber of a thermal spray apparatus to form a stream of combustion gases having supersonic velocity, axially feeding a particulate filler into said stream of high-temperature, high-velocity combustion gases using an axial stream of a carrier gas to entrain said filler in said combustion gases to form a high-temperature, high-velocity substantially collimated stream of filler material in said thermal spray apparatus;

electrically melting the end of a metal wire and atomizing said molten metal directly at the end of said wire with said stream of high-temperature, supersonic velocity combustion gases having said entrained filler at a second location downstream of said thermal spray apparatus chamber, such that said atomized molten metal is entrained in said stream along with said filler to form a substantially collimated stream of high-temperature, high-velocity filler and atomized metal;

directing said stream of high-temperature, high-velocity combustion gases having said entrained filler and said entrained atomized molten metal toward a target; and said filler and said atomized metal entrained in said stream of high-temperature, high-velocity combustion gases forming a deposit on said target, said deposit comprising an abradable material having a substantially continuous metal matrix in which said filler is embedded.

* * * * *